US010105280B2

(12) United States Patent
Buchner Santos et al.

(10) Patent No.: US 10,105,280 B2
(45) Date of Patent: Oct. 23, 2018

(54) MASSAGING DEVICE

(71) Applicant: KONINKLIJKE PHILIPS N.V., Eindhoven (NL)

(72) Inventors: Evelyn Buchner Santos, Eindhoven (NL); Kelly Yang, Eindhoven (NL); Severin Luc Ramses Harvey, Utrecht (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 890 days.

(21) Appl. No.: 14/573,568

(22) Filed: Dec. 17, 2014

(65) Prior Publication Data

US 2016/0175185 A1 Jun. 23, 2016

(51) Int. Cl.

| | |
|---|---|
| ***A61H 15/00*** | (2006.01) |
| ***A61H 7/00*** | (2006.01) |
| ***A61H 23/00*** | (2006.01) |

(52) U.S. Cl.

CPC ..... *A61H 15/0085* (2013.01); *A61H 7/007* (2013.01); *A61H 23/006* (2013.01); *A61H 2015/0042* (2013.01); *A61H 2201/1215* (2013.01); *A61H 2201/1685* (2013.01); *A61H 2201/5035* (2013.01); *A61H 2205/022* (2013.01)

(58) Field of Classification Search

CPC ..... A61H 15/0078; A61H 15/0085; A61H 15/00; A61H 23/004; A61H 23/006; A61H 23/02; A61H 23/0254

See application file for complete search history.

(56) References Cited

U.S. PATENT DOCUMENTS

| | | | | |
|---|---|---|---|---|
| 2,043,114 | A | 6/1936 | Ruttger-Pelli | |
| 3,424,150 | A * | 1/1969 | Meranto | A61H 11/00 15/110 |
| 4,526,163 | A | 7/1985 | Fedders | |
| 5,103,809 | A | 4/1992 | DeLuca et al. | |
| 5,447,491 | A | 9/1995 | Bellandi | |
| 5,769,798 | A | 6/1998 | Frajdenrajch | |
| 6,436,062 | B1 | 8/2002 | Iwamoto et al. | |
| 2003/0167026 | A1 * | 9/2003 | Tsujii | A61H 23/02 601/46 |
| 2004/0158179 | A1 | 8/2004 | Chen | |
| 2004/0167481 | A1 | 8/2004 | Carlucci et al. | |
| 2005/0075591 | A1 | 4/2005 | Hafemann | |
| 2008/0255484 | A1 * | 10/2008 | Gueret | A45D 34/041 601/129 |
| 2008/0262397 | A1 | 10/2008 | Habatjou | |
| 2009/0198158 | A1 * | 8/2009 | Nan | A61H 15/0085 601/87 |
| 2010/0160841 | A1 | 6/2010 | Wu | |
| 2010/0222719 | A1 | 9/2010 | Cowie et al. | |

(Continued)

FOREIGN PATENT DOCUMENTS

| | | | |
|---|---|---|---|
| FR | 2923380 | A1 | 5/2009 |
| JP | 2004016584 | A | 1/2004 |
| RU | 2135146 | C1 | 8/1999 |

(Continued)

*Primary Examiner* — LaToya M Louis

(57) ABSTRACT

A powered massaging device having a drive shaft having an axis of rotation and a massaging head with a skin engaging surface. The massaging head being attachable to the drive shaft for simultaneous rotation about the axis and vibration in a direction along the axis.

4 Claims, 5 Drawing Sheets

(56) References Cited

U.S. PATENT DOCUMENTS

2015/0173842 A1* 6/2015 Carlucci ..... A46B 13/008
606/131

FOREIGN PATENT DOCUMENTS

| | | | |
|---|---|---|---|
| RU | 2135147 | C1 | 8/1999 |
| RU | 69412 | U1 | 12/2006 |
| RU | 106108 | U1 | 7/2011 |

* cited by examiner

MASSAGING DEVICE

FIELD OF THE INVENTION

The present invention relates to a massaging device and, in particular, a powered massaging device that is applied to the body for treating the skin and muscles. Whilst the attachment is primarily intended for use in facial massage, it can also be used to treat other parts of the body.

BACKGROUND OF THE INVENTION

Japanese traditional hand massage techniques include effleurage, tapotement and petrissage. Effleurage is a gentle rhythmic sliding movement across the skin that aims to relax the surface of the skin by working on elastin and collagen fibres and also to engage the muscles to release lactic and uric acid if the pressure is increased. Tapotement is a light tapping movement or rythmical percussion that aims to stimulate the surface of the skin, relax the muscles and stimulate sensory nerve receptors promoting a nervous response. Petrissage is a deeper and higher pressure massage that compresses the underlying muscles with kneading, wringing and skin rolling type movements.

A problem with carrying out the above-described massage techniques by hand is that it is slow and inconsistent and they generally need to be carried out by a trained professional to be done effectively. Whilst a large number of powered hand-held self-massaging devices and attachments do exist, they do not mimic the above-described massage techniques, or do so poorly. However, by replicating the above-described techniques commonly employed by professional masseuses in a powered massage device, a number of beneficial effects can be obtained, including increased blood flow, relaxation and pain relief, increased lymphatic flow, enhanced nerve stimulation, skin tightening and energizing. The user may also be provided with a more general feeling of wellbeing. Furthermore, the massaging device can generate movements that a person's hand is unable to achieve and so can provide a more effective and efficient massage.

SUMMARY OF THE INVENTION

It is an object of the invention to provide a powered massaging device that substantially alleviates or overcomes the problems mentioned above.

According to the present invention, there is provided a powered massaging device comprising a drive shaft having an axis of rotation and a massaging head with a skin engaging surface, the massaging head being attachable to said drive shaft for simultaneous rotation about said axis and vibration in a direction along said axis.

By providing a powered massaging device that has a massaging head that vibrates in a direction along an axis in a direction into the skin whilst at the same time rotating about that axis, a massaging effect is achieved that very closely mimics known Japanese massaging techniques such as Effleurage and Tapotement. The recipient of the massage therefore obtains a pleasant and stimulating experience which they would otherwise be unable to achieve themselves due to lack of expertise and experience. It will also be appreciated that movements obtained via the use of a powered massaging device are are those which are not possible to achieve manually, i.e. using the hands alone, as the powered device can, for example, run at 750 tapping movements per second.

In a preferred embodiment, the massaging head comprises a central hub and a plurality of massaging elements, each massaging element being spaced radially from the central hub and spaced from each other in a circumferential direction about the axis.

This configuration of massaging head is effective in primarily providing a tapotement-type massage in which the elements repeatedly tap against the skin in order to create temporary deformity. Tapotament, i.e. a light tapping movement, stimulates the surface of the skin and relaxes the surface of the muscles. It also promotes lymphatic drainage from the tissue towards the lymph glands and stimulates the sensory nerve receptors. These actions awake a nervous response.

The massaging elements may comprise a plurality of petals integrally formed with the central hub and spaced evenly around the entire circumference of the massaging head.

As the petals are evenly spaced, a continuous and cyclic motion is created.

Ideally, there may be between 6 and 17 petals and the pitch between petals can be less than 23 mm but more than 6 mm. The pitch distance is selected based on a physiological nervous response to a tactile trigger, which creates a temporary deformation on the skin. A pitch of 6 mm has been found to be the minimum distance that will result in a person noticing two distinct tactile stimulations.

The size of the petals is related to the dimensions of a human finger so that the tapping of the petals against the skin mimics the tapping of a finger against the skin.

Each petal preferably extends radially from the hub by a distance of between 3 mm and 8 mm.

A distance of between 3 mm and 8 mm has been found to provide an optimum distance in order to maximise the massaging effect and at the same time avoid causing pain to the user. This distance has been shown to result in large enough deformations of the skin in order to stimulate the sensory system.

The tips of the petals are preferably curved with a radius of between 8 mm and 10 mm, and they may extend in an axial direction by between 8 mm and 15 mm.

The curved radius provides a gentle tapping of the skin without digging into, or breaking, the skin or causing any pain. The axial extent of the petals is selected in order to roughly mimic the size of a human finger.

In another embodiment, the central hub has a surface protruding in an axial direction beyond the petals.

By providing the central hub with a surface that protrudes beyond the petals, the massaging device can be used for different types of massaging effect depending on the orientation in which the device is being held. In particular, if the device is held such that the petals contact the skin, then a tapotement type massage effect is obtained whereas, if the device is held such that the central hub contacts the skin rather than the petals, then a different massage effect can be achieved, such as effleurage.

Preferably, a plurality of spokes extends from the central hub and a freely rotatable element is mounted on each spoke. The freely rotatable element may be a spherical or part-spherical ball.

This configuration of massaging head moves in a way that cannot be achieved using the hand and the spherical or part-spherical balls compress and pinch the skin between them to provide a kneading effect on the skin to reach its deeper layers.

In another embodiment, the massaging head comprises a base plate, the central hub comprises an integral first protruberance upstanding from a centre of said base plate, and the massaging elements comprising a plurality of second integral protruberances upstanding from a peripheral region of said base plate surrounding, and spaced from, said first protruberance.

This configuration of massaging head causes deformation and stretching of the skin. In particular, the skin is stretched between the moving second protruberances and the central protruberance.

The powered massaging device may, according to any embodiments of the invention, comprise a controller configured to rotate the massaging head in a first direction of rotation for a predetermined period of time before rotating the massaging head in a second direction of rotation for a second predetermined period of time.

By providing a level of control, a user may ensure that an effective massage has been achieved. In particular, by causing the massaging head to initially rotate in one direction before rotating in another direction, a user may apply the massaging device to one side of the face and then apply it to the other side of the face once the direction of rotation changes.

The controller may be configured to prevent rotation of the massaging head for a further predetermined period of time after rotating it in said first direction and before rotating it in said second direction.

By stopping rotation of the massaging head for a short period between rotations in opposite directions, a user is provided with time to change between massaging one side of the face to the other. This change in direction facilitates lymphatic drainage, where fluid in the tissues is moved from the centre of the face towards the side of the face where the lymph glands are located.

The controller is preferably operable to control vibration of said massaging head along said axis at a frequency of between 30 and 60 Hz Following tests on users, this frequency has been found to provide an effective and pleasant massage and would not be achievable with a manual device.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which:

FIG. 4(*b*) shows the massaging device of FIG. 1 in use in a first orientation;

FIG. 4(*c*) shows the massaging device of FIG. 1 in use in a second orientation;

DETAILED DESCRIPTION OF EMBODIMENTS

Embodiments of the present invention provide a massaging device with a head that is rotated by the device, whilst also being vibrated in an axial direction. The massaging head has features to massage the skin of a user as it rotates and vibrates, in order to replicate various known massaging techniques, such as effleurage, tapotement and petrissage, as described above. It is envisaged that the massaging device of the invention will be used primarily to massage facial and eye areas.

Figure 1:
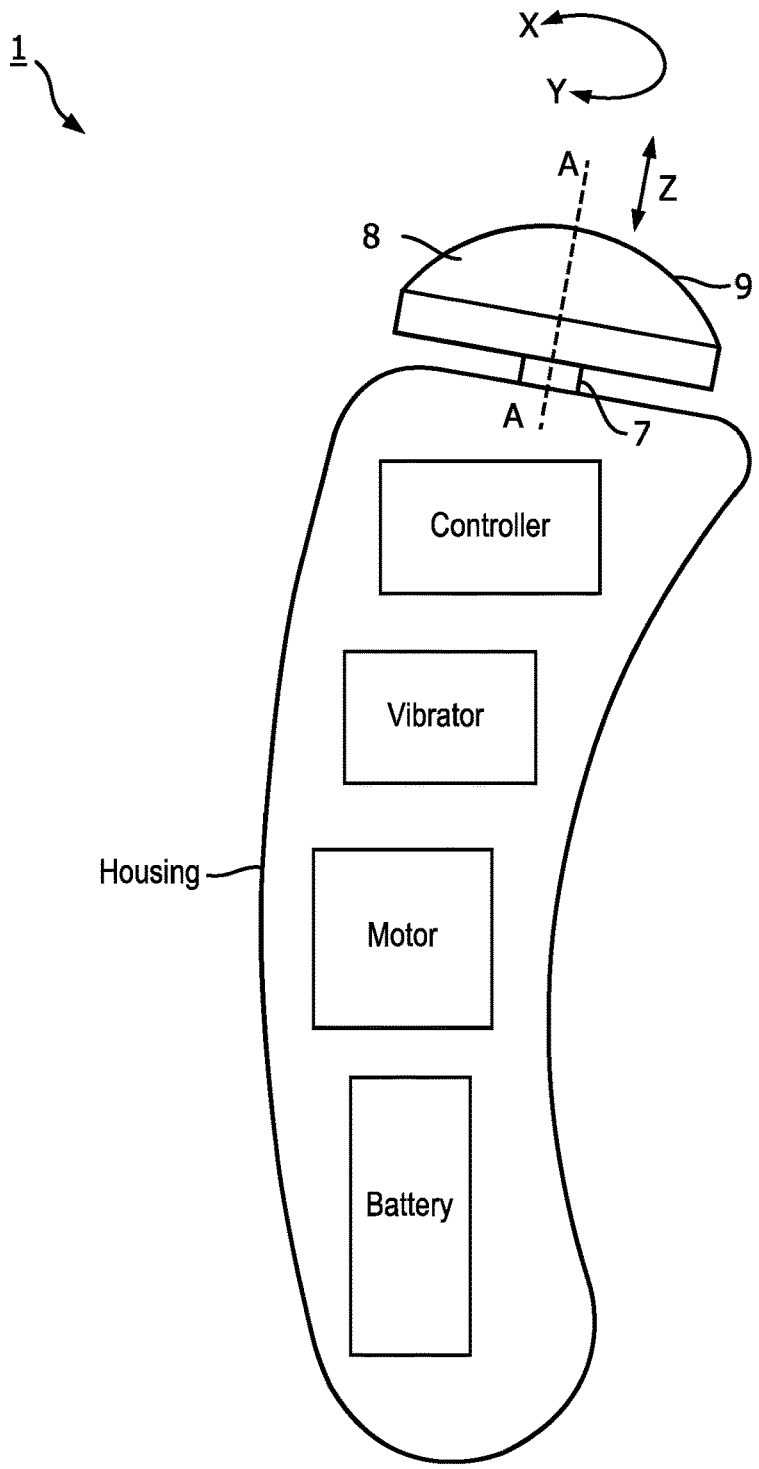
FIG. 1 shows a simplified view of an embodiment of a powered massaging device according to the invention with a massaging head attached thereto.

With reference to FIG. 1, there is shown a generalised view of a massaging device 1 according to an embodiment of the invention. The massaging device 1 has a body or housing 2 which contains a source of power, such as a battery 3, a motor 4, a vibrator 5 and a controller 6. These components are all interconnected in order to drivingly rotate a drive shaft 7, which has an axis of rotation A-A, in either a clockwise or anti-clockwise direction about said axis (i.e. in the direction of arrows X or Y in FIG. 1) and, to cause the drive shaft 7 to vibrate in an axial direction (as indicated by arrow Z). A massaging head 8 is removably attached to the drive shaft 7 and has a skin engaging surface 9.

Figure 2:
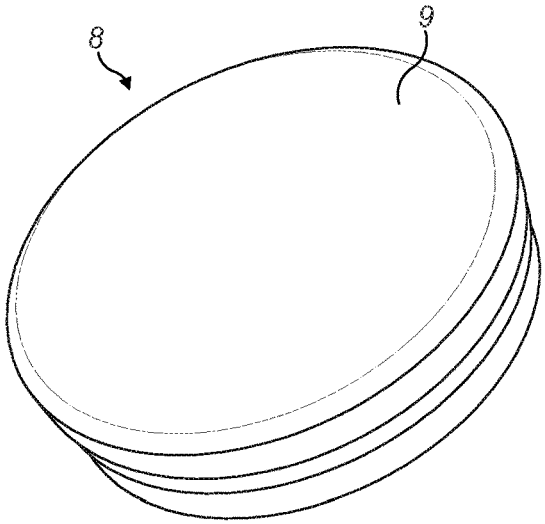
FIG. 2 shows a top perspective view of a first massaging head according to an embodiment of the invention for use with the massaging device of FIG. 1.

FIG. 2 illustrates a first massage attachment according to an embodiment of the invention, for use with the device of FIG. 1. As can be seen from FIG. 2, the skin engaging surface 9 is completely smooth and curved in shape so as to promote a gentle stroking action on the skin. Preferably, the skin engaging surface 9 is also soft and is formed from a low-friction material. Alternatively, the skin engaging surface 9 may be coated with a low-friction material.

The massaging device may be configured to rotate the massaging head shown in FIG. 2 in direction A or B and at a speed of between 100-180 rpm, whilst causing it to simultaneously vibrate in an axial direction C at a vibrational frequency ranging from 30-100 Hz. Most preferably, the massaging head is rotated at a speed of 158 rpm.

The massaging head of FIG. 2 mimics the known type of hand massage technique called effleurage when used with the device of FIG. 1.

Figure 3:
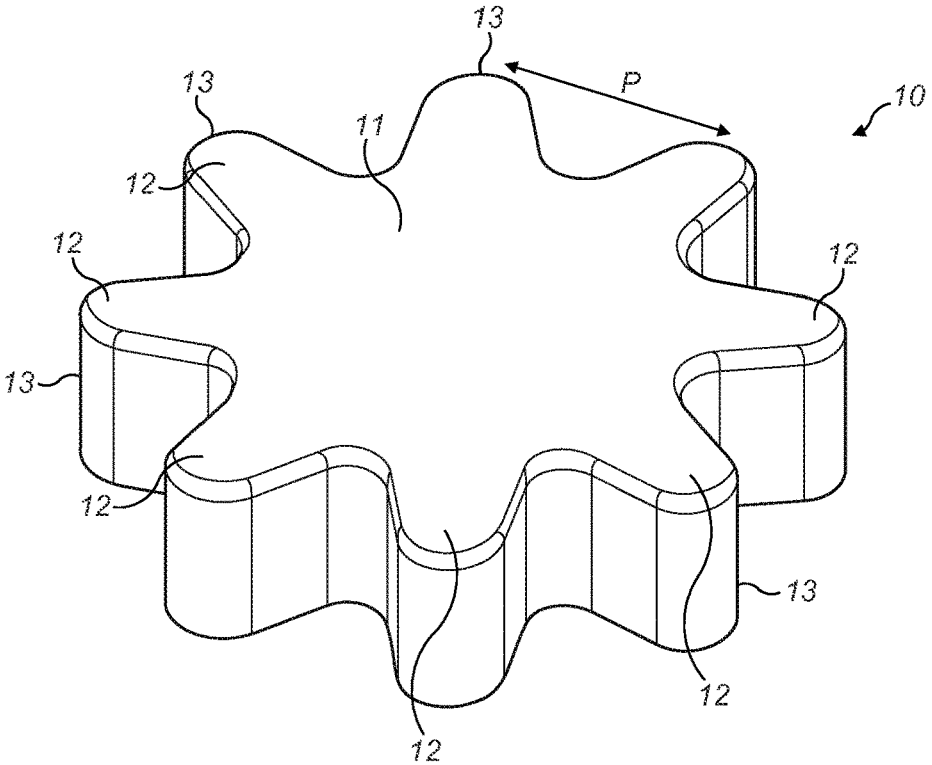
FIG. 3 shows a top perspective view of a second massaging head according to an embodiment of the invention for use with the massaging device of FIG. 1.

With reference to FIG. 3, there is shown an alternative type of massage head 10 for use with the massaging device 1 of FIG. 1, which has a central hub 11, which connects the massaging head to the drive shaft 7 and, a plurality of integrally formed petals 12 extending radially from the central hub 11 spaced from each other around the entire circumference of the central hub 11.

The petals 12 are intended to create a temporary deformation on the skin as the massaging head 10 rotates. The distance between the peaks of the pedals 12 is related to the size of a finger, in order to mimic a tapping motion similar to a finger tapping against the skin. A continuous cyclic motion is created as the pedals are equally spaced.

With the massaging head of FIG. 3, a rotational speed of between 100-180 rpm is preferred following tests with users. Most preferably, the speed is 158 rpm.

Although the embodiment of FIG. 3 shows a massaging head 10 with eight petals 12, the massaging head 10 can be modified within the scope of the invention to have less or more petals 12. A preferred number of petals 12 is between six and seventeen.

Preferably, the distance or pitch P (see FIG. 3) between petals is less than 23 mm, but more than 6 mm. At distances less than 6 mm, little or no sensory response is perceived.

The petals 12 may extend from the central hub 11 by a radial distance R less than 10 mm. It has been found that the ideal radial extent R of the petals 12 is between 3 mm and 8 mm.

Furthermore, each petal 12 has a curved tip 13. The preferred radius of curvature should ideally be in the order of 4 and 5 mm.

Preferably, the petals should extend in an axial direction for a distance of between 8 mm and 15 mm.

The massaging head 10 of FIG. 3 mimics the known type of hand massage technique called tapotement when it is used with the massaging device shown in FIG. 1.

Figure 4A:
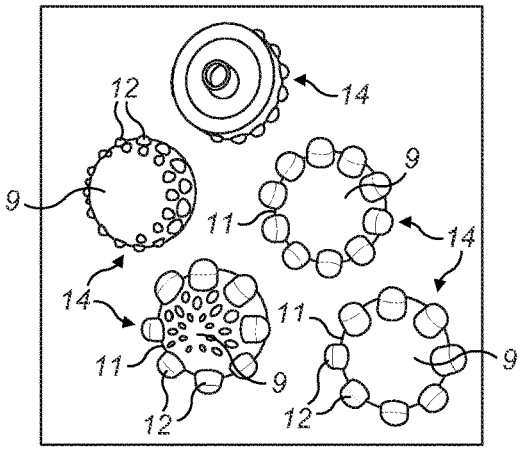
FIG. 4(*a*) shows a number of alternative massaging heads according to embodiments of the invention for use with the massaging device of FIG. 1.
Figure 4B:
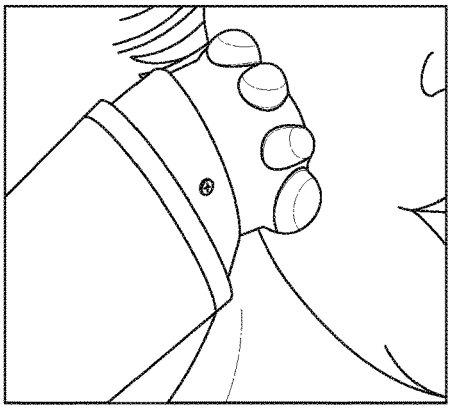
Figure 4C:
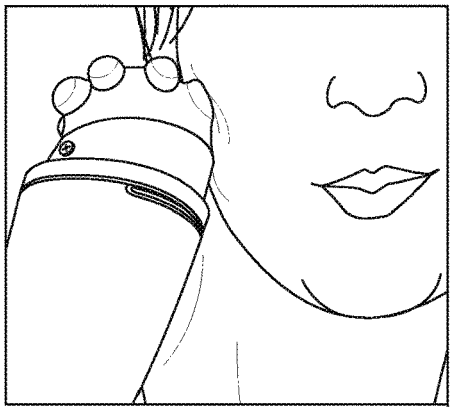

FIG. 4(*a*) illustrates a number of alternative massage heads which combines the smooth skin engaging surface 9 of the massaging head described with reference to FIG. 2 and, the massaging head with petals 12, described with reference to FIG. 3, into a single massaging head. As is clear from each of the massaging heads shown in FIG. 4(*a*), they have a plurality of petals 12 extending from a central hub 11, as in the massaging head 10 of FIG. 3 but, the central hub 11 also has an elevated or domed upper surface 9 that extends beyond the petals 12 in the axial direction.

With reference to FIG. 4(*b*), there is shown a massaging device 1 according to FIG. 1 to which one of the massaging heads illustrated in FIG. 4(*a*) is attached. The massaging device 1 is shown in use and in a first orientation, in which the domed upper surface 9 of the massaging head 14 is placed against the face of a user in order to apply a effleurage type massaging action to the skin. It will be noted that, due to the elevated or raised profile of the central hub 11, the petals 12 that extend radially from the central hub 11 do not come into contact with the skin when the massaging device 1 is used in this first orientation, so a massaging action similar to that experienced with the massaging head 8 described above with reference to FIG. 2 is obtained.

With reference to FIG. 4(*c*), it can be seen that the massaging device 1 of FIG. 1 is shown in use in a second orientation, in which the petals 12 are placed against the face of a user in order to apply a tapotement type massaging action to the skin. It will be noted that, the raised upper surface 9 of the central hub 11 does not come into contact with the skin when the massaging device 1 is used in this second orientation, and only the petals 12 contact the skin. Therefore, in this orientation, a massaging action similar to that experienced with the massaging head 10 described above with reference to FIG. 3 is obtained.

The above-described embodiment of the invention therefore includes a massaging device 1 having a massaging head 14 that is configured to generate different massaging techniques dependent upon the orientation of the massaging device 1 and without any need to change the massaging head 14 for one of a different configuration or design.

Figure 5:
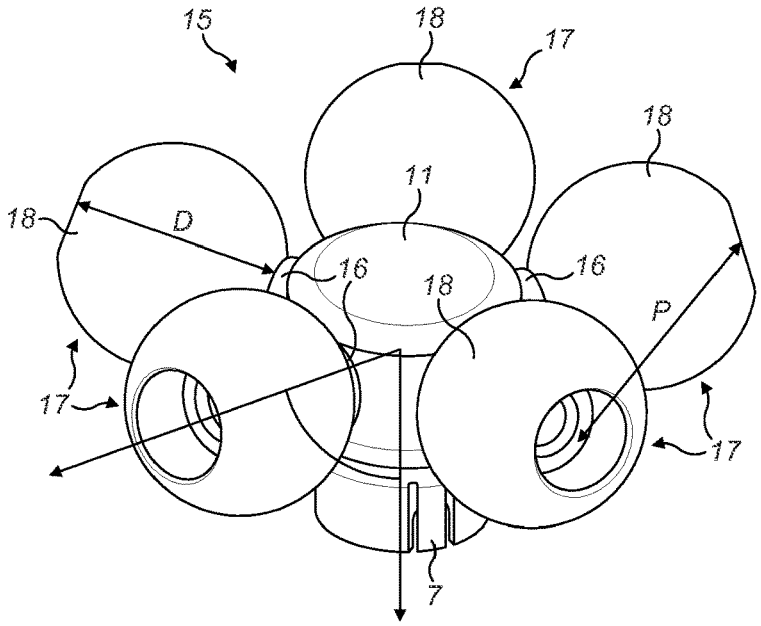
FIG. 5 shows a top perspective view of another massaging head for use with the massaging device of FIG. 1.
Figure 6:
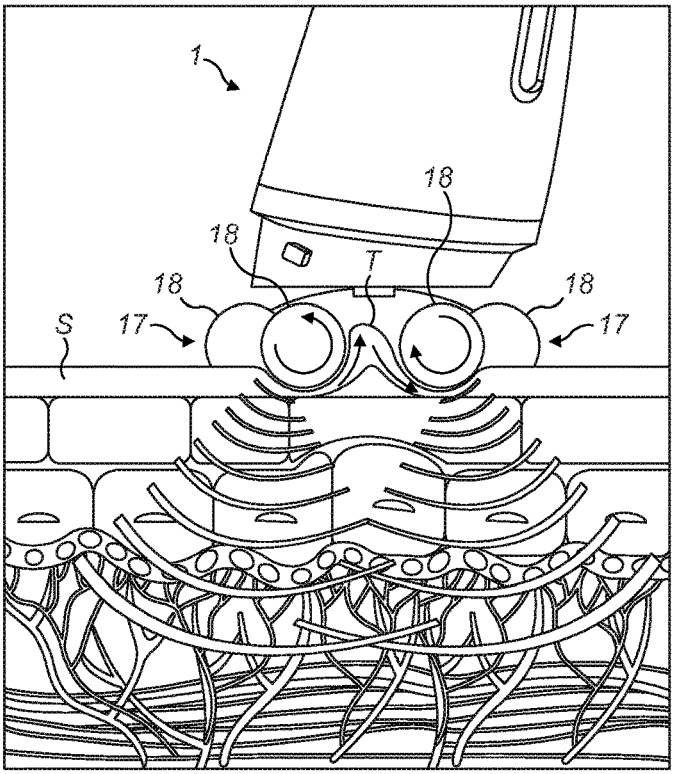
FIG. 6 shows a cross-section through the skin of a user, with the device of FIG. 5 in use.

Another type of massaging head 15 according to an embodiment of the invention is illustrated in FIG. 5. As shown, the central hub 11 is formed with a number of spokes 16 (five being shown in FIG. 5). The spokes 16 extend radially from the central hub 11 and are spaced equidistant from each other. Mounted on each spoke 16 is a freely rotatable element 17. Preferably, each element has a smooth and curved skin-contacting surface 18. Most preferably, the skin-contacting surface 18 on each element 17 is spherical or part-spherical in shape so that the elements 17 each resemble a ball. When the central hub 11 rotates at a frequency in the region of 30-60 Hz, and the elements 17 are pressed against the skin, rotation of the elements 17 cause the skin to be compressed, stretched and pinched, as illustrated in FIG. 6, which shows the device pressed against the surface of the skin S. As the device 1 is moved across the skin surface S, the elements 17 rotate, as indicated by arrow R, causing the skin S to be drawn up and pinched between adjacent elements 17, as indicated by T. The degree of deformation depends on the force applied to the skin S by the user and the elasticity of the skin S. It will be appreciated that the central hub 11 may have a different number of spokes 16 and so the number of balls 17 or elements mounted thereto, as well as their diameter D may be different. For example, three, four or six elements 17 may be used instead of the five shown in FIG. 5. The elements may be made from a number of different materials including hard or soft plastics or elastomers and they may be made from a low-friction material or coated with a a low-friction material. To increase skin stretching, all of the following may be increased namely, the size or diameter of the elements, the number of elements, the rotational speed of the drive shaft, the surface friction of the balls and the pitch P between elements 17.

The above-described massaging head device provides a massaging effect that mimics a petrissage type massage when used with the massaging device shown in FIG. 1.

Figure 7:
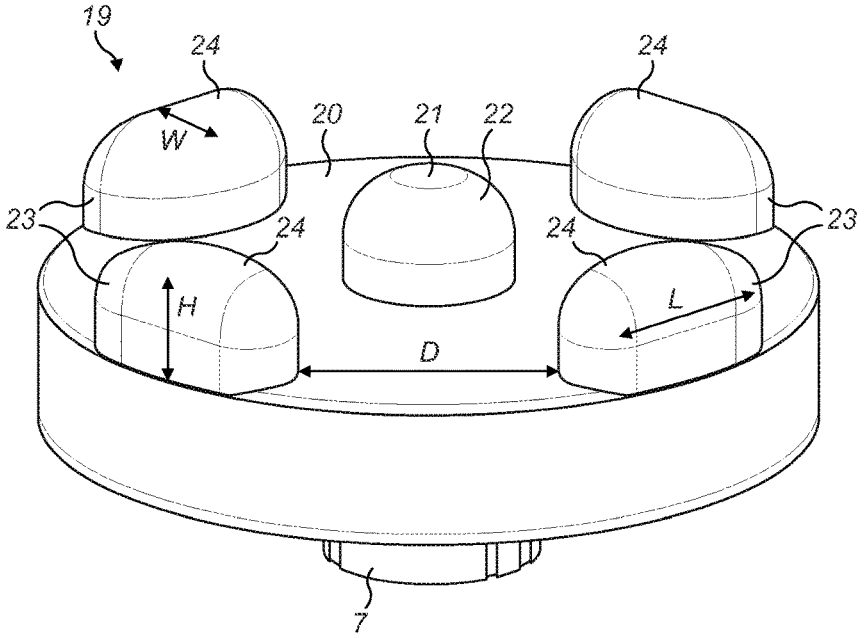
FIG. 7 shows a a top perspective view of another massaging head for use with the massaging device of FIG. 1.

Another embodiment of massaging head 19 that provides a petrissage type massage effect is illustrated in FIG. 7. In this embodiment, the massage head 19 has a planar base surface 20 and the central hub is a raised inner protruberance, knob or bump 21 with a curved outer surface 22 protruding upwardly from the centre of the base surface, coaxial with the axis of rotation A-A of the massaging head 19. A number of peripheral protruberances, knobs or bumps 23 are arranged around the periphery of the massaging head 19 and upstand from the base surface 20. Each of the peripheral protruberances 23 are spaced radially from the inner protruberance 21 and spaced circumferentially from each other. The dimensions of the peripheral protruberances 23 may be altered in order to provide the desired massage effect. In particular, the peripheral protruberance 23 outer height ('H' in FIG. 7) should be between 4 and 5 mm. The width (W) of each peripheral protruberance should be between 5 and 7 mm. The distance between each peripheral protruberance should be between 6 and 12.5 mm. The length (L) of each peripheral protruberance should be between 8 and 12 mm. The number of peripheral protruberances 23 should be between 2 and 4 and preferably, there should be an even number. Petrissage provides a stronger deeper movement manipulating the skin surface through to elastic and collagen fibres and deeper into the muscles. This enhances movement of intercellular fluids and stimulates blood flowenabling better nutrient absorption and release of tense ligaments and muscles. As tested with users these shapes have been found to pinch and knead the skin and provide the most effective massage. Each peripheral protruberance 23 may have a curved outer surface 24 remote from the base 20. The degree of curvature may be altered, as can the speed of rotation of the massage head 19 and the friction of the material from which they are made or the coating that is applied to them.

Figure 8:
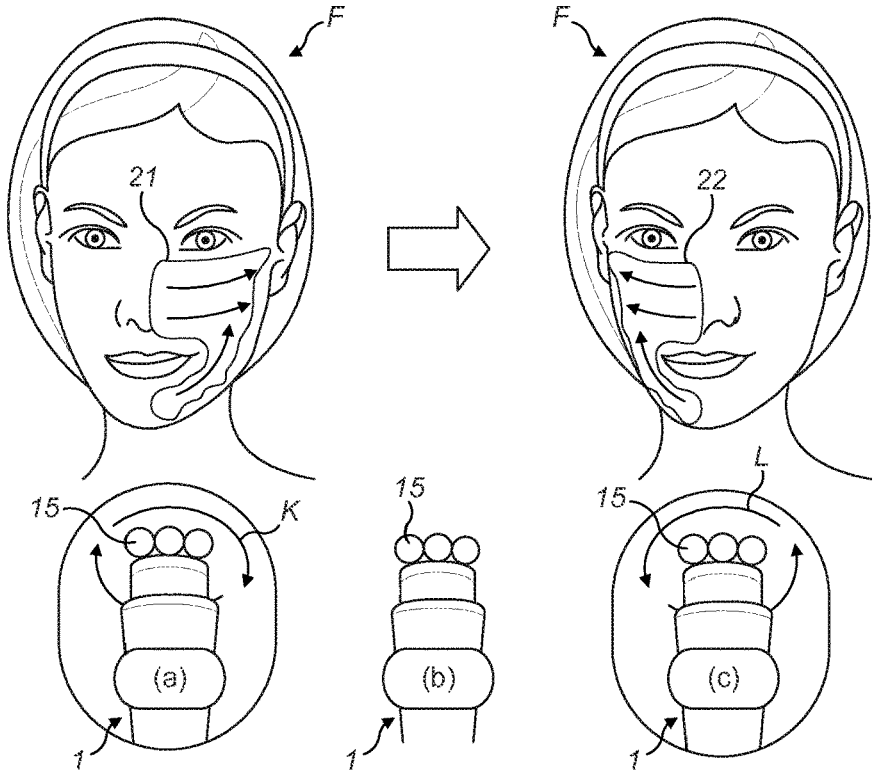
FIG. 8 is a diagram to show how the massaging device according to FIG. 1 may be controlled in order to massage the face.

The controller 6 of the massaging device 1 according to any embodiments of the invention may incorporate a timer and may control operation of the device according to a massaging program. For example, as shown in FIG. 8, the face F can be divided into dual zones z1 and z2. Upon initial switching on of the device 1, the massaging head may rotate in a first direction, as indicated by arrow K, for a predetermined period of time (a), which may be in the order of around 90 seconds, so that the device 1 may be used to massage one side of the face F, i.e. zone z1. When that initial period of time has expired, the controller 6 will briefly pause rotation of the massaging head 15 for a second predetermined period of time (b), which could be in the order of 0.5 seconds. The controller 6 will then rotate the massaging head 15 in the opposite direction, as indicated by arrow L, for a further predetermined period of time for massaging the other side of the face, i.e zone z2, before stopping. By providing a timer and by causing the massaging device 1 to stop between rotating in its first and second directions K, L, a user knows when to apply the massaging device 1 to the opposite side of the face until the program is complete.

To make the user experience more intuitive and the device easier to operate, each massaging head can contain an RFID tag which will store relevant massaging device 1 setting information associated with that massaging head, such as velocity and vibration frequency. As such, when a massage element is connected to the device 1, it will be detected automatically and the adequate rotation and vibration settings will be activated.

It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

Although claims have been formulated in this application to particular combinations of features, it should be understood that the scope of the disclosure of the present invention also includes any novel features or any novel combinations of features disclosed herein either explicitly or implicitly or any generalisation thereof, whether or not it relates to the same invention as presently claimed in any claim and whether or not it mitigates any or all of the same technical problems as does the parent invention. The applicants hereby give notice that new claims may be formulated to such features and/or combinations of features during the prosecution of the present application or of any further application derived therefrom.

The invention claimed is:

1. A powered massaging device comprising:

a drive shaft having an axis of rotation, a massaging head with a skin engaging surface, the massaging head being attachable to said drive shaft for simultaneous rotation about said axis and vibration in a direction along said axis, a controller configured to rotate the massaging head in a first direction of rotation for a predetermined period of time before rotating the massaging head in a second direction of rotation for a second predetermined period of time, and wherein the controller is configured to prevent rotation of the massaging head for a further predetermined period of time after rotating it in said first direction and before rotating it in said second direction while maintaining a single mode of operation, wherein the massaging head comprises a central hub and a plurality of massaging elements, each massaging element being spaced radially from the central hub and spaced from each other in a circumferential direction about the axis, wherein the massaging elements comprise between 6 and 17 petals integrally formed with the central hub and spaced evenly around the entire circumference of the massaging head wherein a pitch between the petals is less than 23 mm but more than 6 mm, wherein tips of the petals are curved with a radius of between 8 mm and 10 mm, and wherein the central hub has a domed upper surface protruding in an axial direction beyond the petals.

2. A powered massaging device according to claim 1, wherein each of the petals extends radially from the hub by a distance of between 3 mm and 8 mm.

3. A powered massaging device according to claim 1, wherein the petals extend in an axial direction by between 8 mm and 15 mm.

4. A powered massaging device according to claim 1, wherein the controller is operable to control vibration of said massaging head along said axis at a frequency of between 30 and 60 Hz.

* * * * *